United States Patent [19]

Bienko et al.

[11] 4,079,997

[45] Mar. 21, 1978

[54] PHOTOELECTRIC METHOD AND DEVICE FOR CONTROL OF A MINING MACHINE ALONG A BED OF MINERAL

[76] Inventors: Jury Nikolaevich Bienko, ulitsa Kalinina, 20, kv. 62; Vitaly Pavlovich Vlasov, ulitsa Karbysheva, 11, kv. 55; Valentin Viktorovich Baranov, ulitsa Kakhovskaya, 45, kv. 22; Vladimir Antonovich Pilipovich, prospekt Lenina, 76, kv. 55, all of Minsk; Anatoly Mikhailovich Pivovarov, ulitsa Leninskogo Komsomola, 26, kv. 26, Soligorsk, all of U.S.S.R.

[21] Appl. No.: 722,208

[22] Filed: Sep. 10, 1976

[51] Int. Cl.[2] ..... E21C 35/08

[52] U.S. Cl. ..... 299/1; 250/226; 250/254

[58] Field of Search ..... 299/1; 250/226, 254

[56] References Cited

U.S. PATENT DOCUMENTS

| | | | |
|---|---|---|---|
| 2,741,468 | 4/1956 | Alspaugh | 299/1 |
| 3,200,575 | 8/1965 | Hurst | 250/226 X |
| 3,333,893 | 8/1967 | Heimaster | 299/1 |
| 3,821,550 | 6/1974 | Priest | 250/226 |

*Primary Examiner*—Ernest R. Purser

*Attorney, Agent, or Firm*—Lackenbach, Lilling & Siegel

[57] ABSTRACT

A photoelectric method of automatically controlling motion of a mining machine along a profile of a bed of a mineral deposit is described. A section of a face having at least two beds having different colors is illuminated. The reflected light flux is detected and the beds are distinguished by their colors. The boundary of the selected beds is tracked by identifying their color. The light flux reflected from each of said beds is converted into an electric signal by means of a photoelectric receiver. The direction of deviation of the mining machine with respect to the boundary of the selected beds is determined and the motion of the machine is corrected correspondingly. The device for effecting the proposed method includes a light source, an objective and a photoelectric receiver for conversion of the reflected light flux into electric signals. Located between the objective and the photoelectric receiver is a scanner unit for scanning the reflected light fluxes. Connected to the photoelectric receiver is a unit for separating electric pulses. The device is provided with a synchronizer connected to the scanner unit and the unit for separating the electric pulses, which provides simultaneous operation of these units. The output of the signal separating unit is connected to a unit for operative storage and comparison of pulses whose output is connected to a comparator unit to compare the obtained difference of the pulse parameters with a value specified for the given beds. The comparator unit is connected to an actuating member to move the objective, which is connected to the unit for measuring the value of deviation of the mining, machine, which, in turn, is connected to a unit for comparing the value of deviation of the machine with a specified allowance for accuracy of guiding the machine. The unit for comparing the value of deviation with the specified allowance for accuracy of guiding the machine is connected to a unit for shaping control signals to control the motion of the machine.

12 Claims, 10 Drawing Figures

PHOTOELECTRIC METHOD AND DEVICE FOR CONTROL OF A MINING MACHINE ALONG A BED OF MINERAL

The present invention relates to the field of automatic control of mining machines and, more particularly, the invention relates to photoelectric methods for controlling the motion of a mining machine along a mineral bed and to a device for carrying this method into effect.

The present invention is preferably used at deposits having beds of different color and occuring frequently, e.g. potassium deposits.

Widely used in mining engineering practice are methods and devices for controlling the motion of mining machines based on measurement of the deviation of a development machine from a specified direction on the basis of optical parameters, for example by means of an optical beam. In devices of such type a source of directed light is usually mounted at the beginning of a drift, and a light receiver comprising photoelectric cells is mounted on the mining machine. Quantum optical oscillators can be used as light sources. A light beam, on an artifical orientation base with respect to which the movement of the cutting loading machine is specified. The light beam is directed to a photoelectric receiver mounted on the machine, the deviation of the mining machine is compared to the specified value, an error signal is generated, and control signals are sent to the actuating members of the machine.

However, it should be noted that guiding the mining machine strictly along the light beam is inexpedient, since in this case considerable reserves of useful minerals remain undeveloped.

Also known in the art are methods and devices for automatically controlling the motion of mining machines based on utilization of a natural orientation base, in particular, the orientation of the mining machine by the profile of a mineral bed.

One of the methods involves irradiating a section of the bed near the rock-bed boundary of the mineral deposit with ultrasonic waves. The device for performing this method comprises an ultrasonic wave generator mounted on the mining machine, which includes an electric oscillator element made in the form of a metal rod vibrator provided with two fixed piezoelectric crystals. In order to provide radiation of ultrasonic waves in a face, constant contact of the rod vibrator with the face is provided near the rock-bed boundary. The reflected ultrasonic waves are transformed into electric signals, which are introduced into the feedback circuit of the generator. In this case there is provided stable radiation of ulstrasonic waves, when the rod vibrator contacts one bed, the radiation being stopped as soon as the rod vibrator is in contact with another bed or rock. Such adjustment of the generator allows the character of the detected reflected signals to be used for distinguishing a mineral bed from rock and to effect motion of the cutting loading machine near the bed-rock boundary of the mineral deposit.

A considerable disadvantage of such devices is that their reliable operation requires constant pressure of the rod vibrator to the face, which in practice is very difficult to provide so that reliable information about the position of the mining machine in the face cannot be obtained.

Known in the prior art are a method and apparatus for controlling a boundary of two beds, for example coal and rock, based on a change in the parameters of a high-frequency system depending on the thickness of the mineral layer. In this case a high-frequency signal is irradiated into the rock, the parameters of the high-frequency oscillatory system are compared with the predetermined values and control signals are generated.

The apparatus realizing this method comprises a self-excited oscillator mounted on a mining machine, an oscillatory system (antenna) located in immediate vicinity of the soil layer or bed being checked and a comparison circuit to comparing the parameters of the oscillatory system mounted on the machine with a specified value.

The antenna of the oscillator is in the immediate vicinity of the checked mineral layer, which in this case is an integral part of the oscillatory system. The system is adjusted so that a definite thickness of a mineral layer corresponds to definite parameters of the oscillator. Any change in the thickness of this layer results in a change in the parameters of the oscillatory system, its capacitance, Q-factor and resonance frequency, as well as in the parameters of the oscillator. This unbalances the system, and the comparison circuit produces error signals corresponding to the polarity and magnitude of deviation of the layer thickness from the specified value. The main disadvantage of such a method consists of that the parameters of the oscillatory system are strongly influenced by the operating conditions, for example humidity; therefore, practical application of such devices is hindered.

Also known in the art is a photometric method of controlling the motion of a cutting loading machine based on different reflection coefficients of mineral layers and rock. The device carrying this method into effect consists of a light source mounted on the machine and illuminating the face near the interface between the mineral bed and rock, the light beam falling at an acute angle. The reflected light flux from the bed or rock falls on a photoelectric receiver, placed at an acute angle to the face symmetrically to the light source, and is converted into an electric signal applied to an amplifier input. The position of the cutting loading machine is detected by a indicator connected to the amplifier output and indicates the magnitude of the reflection coefficient. The reflection coefficient can be used for controlling the position of the machine in the rock or mineral bed. This method has a number of significant disadvantages.

The magnitude of the measured reflection coefficient to a large extent depends on the roughness of the controlled surface, the light source stability, the dust content in the air, etc.. Therefore, practical application of such devices is rather difficult.

An object of the present invention is to provide a method of automatically controlling motion of a mining machine along a mineral bed and a device for effecting this method to ensure accurate orientation of the machine with respect to the bed boundary.

Another object of the invention is to increase the quality of the ore being delivered to the surface and the provide complete withdrawal of ore from the bed.

Still another object of the invention is to increase the reliability of operation of the mining machine and to improve the automatic control quality.

These objects are achieved with the proposed photoelectric method of controlling the motion of a mining machine along the profile of a mineral bed, the method involves illuminating a face section having at least two beds. The reflected light flux is detected and the beds are distinguished by their optical parameters; the light flux reflected from each bed is converted into an electric signal by means of a photoelectric receiver and a direction of deviation of the machine from the bed plane is determined. Control signals are generated depending on the machine deviation, which control signals are fed to the actuating members of the mining machine. According to the invention, different colors of the beds are used as optical parameters to allow the interface of the beds to be followed by their color.

It is desirable that in the photoelectric method of automatic control of motion of the machine along the bed profile the identification of the beds by their color is effected by alternately detecting within a specified time interval the light fluxes reflected from the adjacent beds having different, colors; producing a periodic train of pulses corresponding to the color of the selected beds on a monotonically changing section of the characteristic of the photoelectric receiver; and separating the produced pulses in accordance with the order of reception of the reflected light fluxes.

It is desirable that in the photoelectric method of automatic control of motion of a mining machine along the bed profile the tracking of the position of the boundary of the selected beds is effected by means of operative storage, comparison of the separated pulses and keeping the obtained difference constant for the given color ratio of the selected beds.

The photoelectric method of automatic control of motion of a mining machine along the profile of a mineral bed is preferably provided with autonomous tracking of the position of the boundary of the beds being controlled, said tracking being independent of the direction of motion of the machine.

In the photoelectric method of automatic control of motion of a mining machine along the profile of a mineral bed with autonomous tracking it is desirable to determine the value of deviation of the machine from the bed profile by measuring the tracking parameters with respect to the position of the machine in the bed profile, to level the value of deviation of the machine from the bed profile and, by comparing it with a predetermined value of accuracy of guiding the machine, to eliminate insignificant changes and sharp fluctuation of the bed profile for producing control signals when this accuracy is violated.

The device for effecting the method of automatic control of motion of a mining machine along a mineral bed comprises a light source of illumination of a face section; an objective for receiving the light flux reflected from the face and a photoelectric receiver located behind the objective for converting the reflected light flux into electric signals, which through an amplifier are fed to a unit for producing control signals connected to the actuating members of the machine. According to the invention, the device is provided with a scanner unit for scanning the reflected light fluxes located between the objective and the photoelectric receiver and connected to a unit for separating the generated electric pulses; the scanner unit and the unit for separating the generated electric pulses are connected to a synchronizer providing simultaneous operation of these units. The output of the unit the for separating generated pulses is connected to a unit for operative storage and comparison of the electric pulses obtained by means of conversion of the reflected light fluxes whose output is connected to a comparator unit to compare the obtained difference in the parameters of the electric pulses with the value specified for the given beds. The comparator unit, through an actuating member of the objective drive, is connected to a unit for measuring the deviation of the mining machine from the bed profile, the output of this unit being connected to a device for comparing the deviation with the specified allowance for this deviation connected to the unit producing control signals for controlling the machine.

The proposed method of automatic control of motion of a mining machine and a device for effecting this method provide quality and reliable orientation of the machine by the bed profile due to identification of the beds by their colors and tracking of the interface between the beds.

Furthermore, the autonomous tracking of the bed boundary, which is independent of the motion of the mining machine, provides optimum operating conditions of the machine and reliable tracking.

In addition, the quality of the produced ore and the completeness of its recovery are increased due to an increase in the accuracy of tracking the bed boundary.

The invention is further described by way of example with reference to the accompanying drawings, in which.

Figure 1:
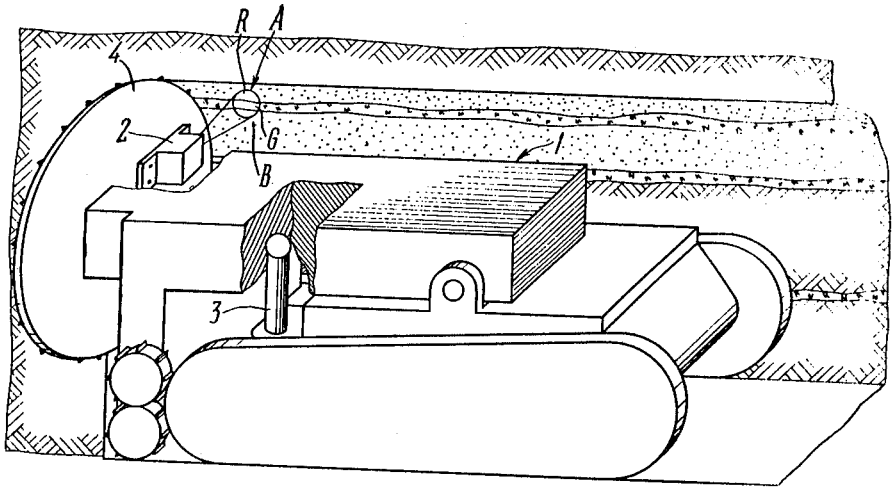
FIG. 1 shows the position of the mining machine in the bed plane.

The proposed photoelectric method of automatically controlling the motion of a cutting and loading or mining machine along the bed profile of a mineral deposit includes the following. When the machine 1 (FIG. 1) is in the plane of the mineral layer, a section A of the face located at a lateral side of the machine 1 is illuminated. The illuminated section A of the face should include at least two beds of different colors. In potassium deposits, where the proposed method is most expedient, there is a great number of beds and small layers due to specific geological formation of potassium deposits. In other occurences it is possible to illuminate a face section having a rock-bed boundary. In this case the controlled motion of the mining machine 1 is effected along this boundary.

The illuminated section A of the face reflects light and the reflected light flux is received by a device 2 and converted into electric signals. The latter are used for identification of the boundary of one or two beds with respect to the adjacent beds having different colors, and tracking of the position of the boundary is carried out. After that the direction and magnitude of deviation of the machine 1 relative to the bed profile is determined.

Depending on the magnitude and direction of the deviation of the mining machine 1 from the bed profile, control signals are generated, which are transmitted to the actuating members 3 of the machine 1 and cause the cutting member 4 of the machine 1 to move up or down. Thus, the mining machine 1 follows the bed profile.

In the present invention the colors of the beds are used as optical parameters allowing one to distinguish the beds and to follow their boundaries. In potassium or similar geological formations the bed color is a universal optical parameter, which enables the beds to be identified even at low-intensity illumination regardless of the quality of the surface of the illuminated face and the dust content therein.

Let us consider a practical embodiment of the proposed method.

The proposed photoelectric method of automatically controlling of motion a mining machine 1 along a bed of a mineral deposit is effected as follows. When the machine 1 (FIG. 1) is in the plane of the mineral bed, the face section A located at the side of the machine 1 is illuminated. This section A includes at least two beds having different colors.

The light flux reflected from the section A of the face is received by an objective 5 (FIG. 2) provided in a device 2 (FIG. 1) for effecting the proposed method.

An initial adjustment of the objective 5 (FIG. 2) with respect to the illuminated face section is effected so that the selected monitored boundary of the two beds is within the field of view of the objective 5 and divides this field into two equal parts. Thus, after the adjustment, the reflected light flux will be detected from at least two beds.

The reflected light fluxes are then scanned, i.e. at each definite instant of time the reflected light flux from one of the two equal parts viewed by the objective 5 is sensed. These reflected light fluxes are converted by a photoelectric receiver 6 into a periodic train of electric pulses, which are shaped on the monotonically varying portion of the characteristic of the photoelectric receiver 6 having different sensitivity to the different color of the beds.

In this case the difference in color may consists in the difference in the spectral composition of the light fluxes reflected from the beds, difference in the color intensity of the reflected light fluxes or in their combination.

Therefore, for shaping a periodic train of distinctive pulses corresponding to concrete beds of the mineral deposit, the spectral and integral characteristics of the photoelectric receivers are selected so that in the absence of difference in the intensity of color of the beds and with significant difference in the color of the adjacent beds, the spectral characteristic has a monotonically-varying section for the range of color of the beds being monitored. When there is no important spectral difference in the beds, the integral characteristic of the photoelectric receiver 6 should have a monotonically-varying section for the color intensity range of the monitored bed.

The photoelectric receiver may comprise one ar several photoelectric cells. Should it be impossible to select a suitable type of a single photoelectric cell, the pulses are generated in a photoelectric receiver consisting of a group of photoelectric cells having different characteristics so that their total characteristic gives a required results.

Figure 4:
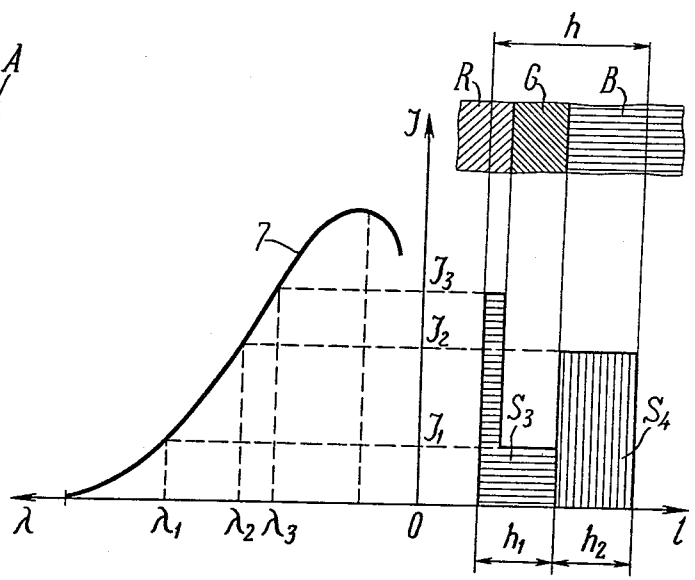
FIG. 4 shows a diagram of shaping electric signals when the machine deviates from the bed profile.
Figure 3:
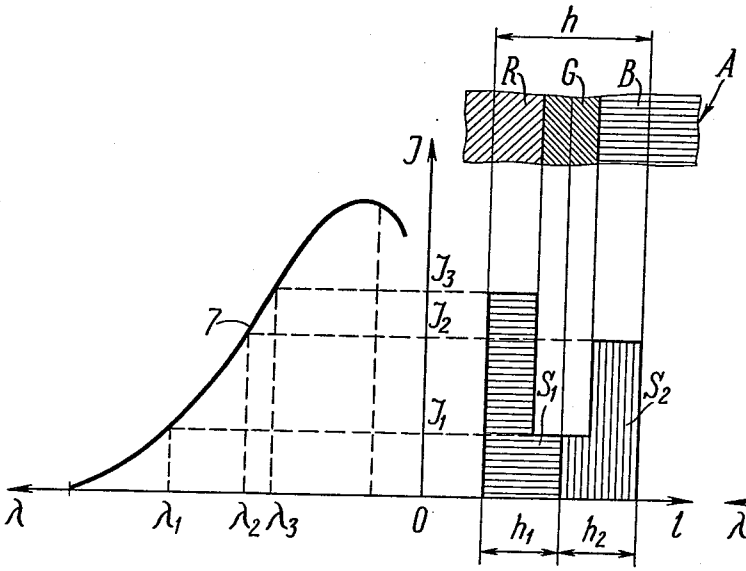
FIG. 3 shows a diagram of shaping electric signals when the machine is exactly in the bed profile.

FIGS. 3 and 4 illustrate the principle of shaping electric pulses depending on the colour of the adjacent beds.

FIGS. 3, 4 present a spectral characteristic (curve 7) of the photoelectric receiver 6.

Plotted on the abscissa axis to the right from the ordinate axis is a wavelength $\lambda$ of the reflected light fluxes of the beds, where $\lambda_1$ is the wavelength corresponding to the bed R (FIGS. 1, 2, 3, 4) of red color (e.g. sylvinite), $\lambda_2$ is the wavelength corresponding to the bed G of green color (e.g. clay), $\lambda_3$ is the wavelength corresponding to the bed B of blue color (e.g. common salt). $\lambda_1$–$\lambda_3$ is the spectral characteristic (curve 7, FIGS. 3, 4) of the photoelectric receiver 6. It has a monotonically or substantially linearly varying section with essentially different sensitivity to the wavelength $\lambda_1$, $\lambda_2$, $\lambda_3$. The photoelectric receiver current $I_{mA}$ is plotted on the ordinate axis, the vertical size of the face image is plotted on the abscissa axis to the right from the ordinate axis, where $h$ is the scanning range in the field of view of the objective 5 (FIG. 2), $S_1$ and $S_2$ (FIGS. 3, 4) are the areas of the shaped pulses produced during the scanning of the above-mentioned section of the face, $I_1$, $I_2$, $I_3$ are the photoelectric currents corresponding to the wavelengths $\lambda_1$, $\lambda_2$, $\lambda_3$ of the light fluxes reflected from the beds R, G and B (FIGS. 1, 2, 3, 4).

When the mining machine 1 is exactly in the bed plane, the boundary of the two beds (in our example - a small layer G (FIG. 3) differing in color from the adjacent layers) is in the centre of the scanning range $h$. When scanning the face image during a time period $T_1$, the photoelectric receiver 6 (FIG. 2) receives the reflected light flux in the subrange $h_1$. In this case on the spectral characteristic (curve 7, FIG. 3) of the photoelectric receiver 6 (FIG. 2) there is shaped a current pulse whose magnitude depends on the color of the light flux reflected from the bed. At the same time, the photoelectric receiver 6 generates a voltage pulse $U_1$ (FIG. 5) whose amplitude is determined by the area $S_1$ (FIG. 4).

In a time period $T_2$ (FIG. 5) the photoelectric receiver 6 (FIG. 2) receives the reflected light flux in the scanning range $h_2$ (FIG. 3). In this case on the spectral characteristic of the photoelectric receiver 6 there is shaped a voltage pulse $U_2$ (FIG. 4) whose amplitude is proportional to the area $S_2$ (FIG. 3). Then this sequence of reception of the reflected light fluxes is repeated.

Produced at the output of the photoelectric receiver 6 (FIG. 2) is a cyclic train of voltage pulses $U_1$ and $U_2$ (FIG. 5) the amplitude of which depends on the colors of the scanned sections of the sub-ranges $h_1$ and $h_2$ (FIG. 3) of the scanning range $h$. The obtained pulses are then separated so that the voltage pulse $U_1$ (FIG. 5) strictly corresponds to the reflected light flux in the subrange $h_1$ (FIG. 3) and the voltage pulse $U_2$ (FIG. 5) strictly corresponds to that from the section $h_2$ (FIG. 3). The separated pulses are stored and compared with each other, the amplitude of the voltage pulse $U_1$ (FIG. 5) obtained during a time period $T_1$ being compared to the amplitude of the voltage pulse $U_2$ obtained during a time period $T_2$.

The obtained difference in the amplitudes of the voltage pulses $E_1 = U_1 - U_2$ is constant for the given relation of color of the illuminated face section.

In the case of the beds having the same color of different intensity there occurs similar generation of electric pulses; however, in this case the process of shaping the pulses corresponding to the beds with different color intensity should be studied on the integral characteristic of the photoelectric receiver 6 (FIG. 2) representing the dependence of the current of the photoelectric receiver on the intensity of the light flux (not shown). In this case we also have a difference in the amplitudes of the pulses, E, which is constant for the given color relation different beds of the illuminated section of the face. The proposed method can also successfully be used in the case when the beds differ both in color and its intensity.

The difference $E_1$ in the amplitudes of the pulses obtained when the machine 1 (FIG. 1) is exactly in the bed profile is considered as specified.

Figure 5:
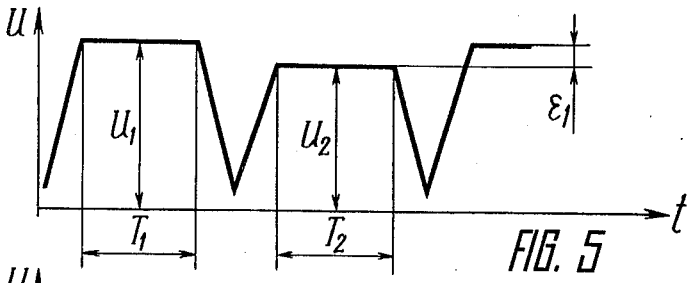
FIG. 5 is a diagram of shaping electric pulses corresponding to the color ratio of the selected beds when the machine is in the bed profile.

When the machine 1 deviates from the bed profile, the monitored beds deviate from the centre of the scanning range *h* (FIG. 4) and on the spectral characteristic (curve 7) of the photoelectric receiver 6 (FIG. 2) there are shaped electric pulses with areas $S_3$ and $S_4$ (FIG. 4) corresponding to a train of voltage pulses having amplitudes $U_3$ and $U_4$ (FIG. 5).

The comparison of the amplitudes of these pulses results in a difference $E_2 = U_3 - U_4$, which is distinct from $E_1$ due to a change in the relations of the color of the reflected light fluxes. The obtained value $E_2$ is compared with that specified for the given relation of color of the selected beds, i.e. $E_1$, thus obtaining a difference in the pulse amplitudes compared to the predetermined amplitude.

Then autonomous tracking of the boundary of the two beds, is effected, which is independent of the motion of the machine 1 (FIG. 1); in the given case the monitored layer G is being followed. The tracking is achieved because the monitored layer G is always maintained in the centre of the scanning range *h* (FIG. 4). This is effected by continuously keeping the pulses in necessary relationship when $E_1 = E_2$. This provides for autonomous tracking of the monitored layer G of the boundary of two layers, which is independent of the motion of the cutting and loading machine 1 (FIG. 1).

Consequently, the deviation of the machine 1 from the bed profile is determined by measuring the change in the tracking parameters with respect to the initial parameters having been found, when the machine 1 was exactly in the bed profile.

Figure 7:
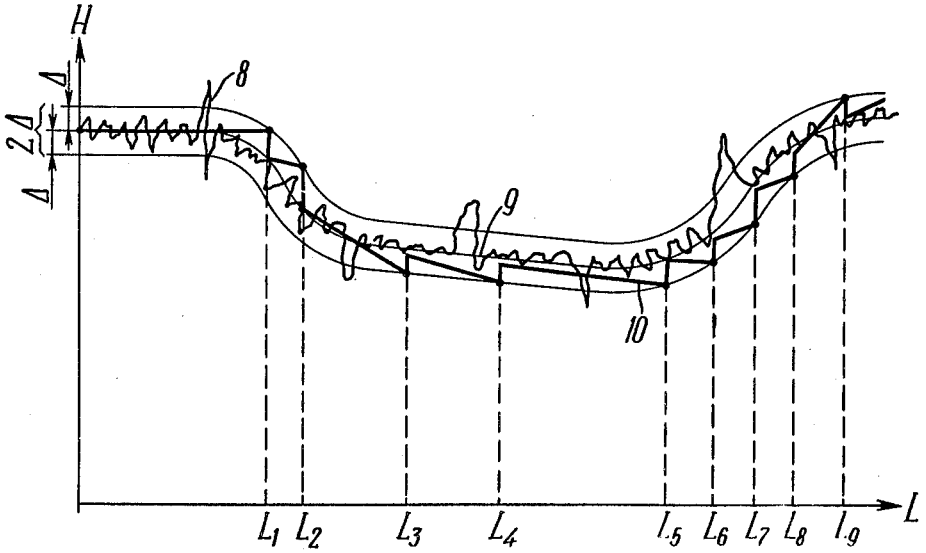
FIG. 7 is a diagram of motion of the cutting member along the bed profile.

After that, the value of the deviation of the machine 1 from the bed profile is levelled and is compared with the specified value of the tolerance in the accuracy of guiding the machine thus eliminating the effect on the signals of insignificant variations, and sharp fluctuation of the bed profile. This process is shown schematically in FIG. 7, where the curve 8 shows a change in the profile of the mineral deposit bed. The line 9 shows averaged changes in the bed profile. $2\Delta$ is the allowance for the accuracy of guiding the machine relative to the averaged profile of the bed (line 9). The line 10 shows the path of the cutting member 4 (FIG. 1) of the cutting and loading machine 1 in the bed profile. The length of the bed in meters is plotted on the abscissa axis L, while the height H of the bed in centimeters is plotted on the ordinate axis. When the machine 1 (FIG. 1) moves along the bed profile, the control signals for changing the position of the cutting member 4 of the machine 1 are generated when the averaged value of deviation of the machine 1 exceeds the specified allowance for the accuracy of guiding the machine (at points $L_1$-$L_9$ in FIG. 7). The control signals are sent to the actuating members 3 (FIG. 1), which move the cutting member 4 of the machine 1 up or down. Thus, accurate and smooth motion of the mining machine 1 along the bed of the mineral deposit is provided.

Figure 2:
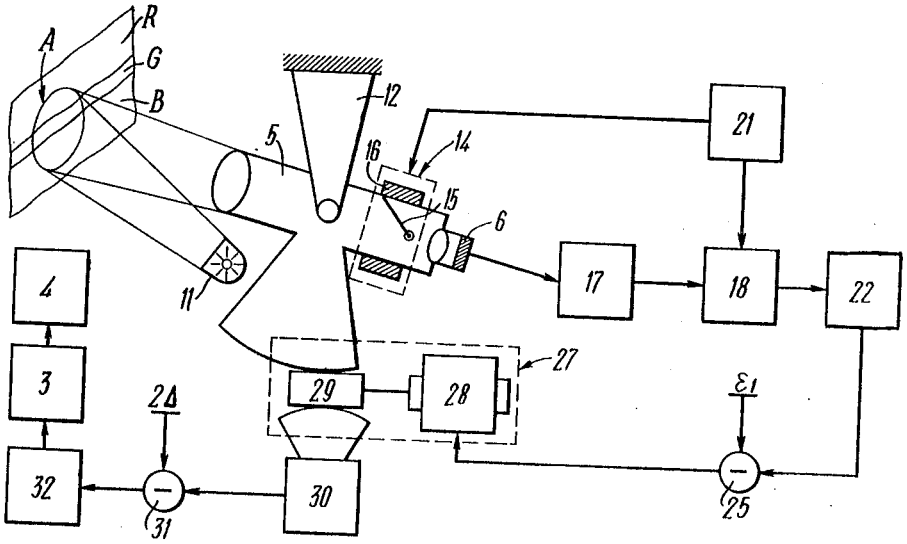
FIG. 2 is a functional diagram of the device for effecting the photoelectric method of controlling the motion of the mining machine along the profile of a mineral bed.

A functional diagram of the device carrying the proposed method into effect is shown in FIG. 2.

Figure 8:
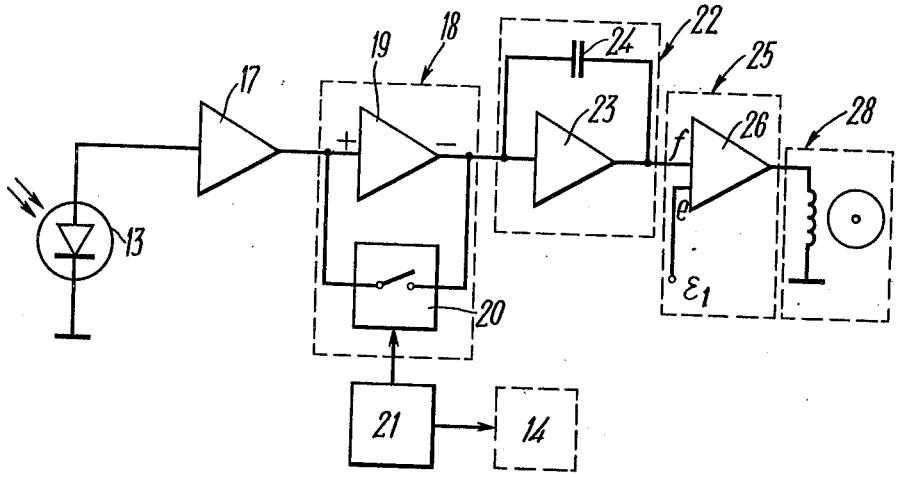
FIG. 8 is a structural electrical diagram of the device for effecting the photoeleltric method of automatically controlling the motion of the mining machine along the bed profile of a mineral deposit.

The proposed device comprises a light source 11 (FIG. 2) mounted on the mining machine 1 (FIG. 1), which illuminates a face section A consisting of at least two beds R and B having different color. The device has an objective 5 (FIG. 2) to receive the reflected light flux mounted on the machine 1 (FIG. 1) through a hinge joint 12 (FIG. 2), a photoelectric receiver 6 converting the reflected light flux into an electric signal. The photoelectric receiver 6 is mounted in the objective 5 and consists of one or several photoelectric cells. In the given device the photoelectric receiver 6 is based on a photodiode 13 (FIG. 8). Located between the objective 5 (FIG. 2) and the photoelectric receiver 6 is a scanner unit 14 made so as to divide the reflected light flux into two equal parts by alternately closing each of these parts so that in any specified interval of time the scanner unit 14 passes the reflected light flux from only one of these parts. In a practical embodiment of the invention the scanner unit 14 is made in the form of a diaphragm 15 secured inside the objective 5 and closing the light fluxes in turn under the effect of electric magnets 16.

The output of the photoelectric receiver 6 is connected to an amplifier 17 whose output is connected to a unit 18 for separation of the produced electric pulses. In the given embodiment of the invention this unit 18 consists of an operational inverter 19 (FIG. 8) and a switch 20 connected in parallel. The unit 18 separates the electric pulses depending on their correspondence to the reflected light fluxes and one of these pulses is inverted. The switch 20 is controlled by a synchronizer 21 (FIGS. 2, 8) connected to the scanner unit 14 and to the switch 20 of the unit 18 for separation of the produced electric pulses to provide their simultaneous operation. Connected to the output of the unit 18 for separation of the shaped electric pulses is an operative memory unit 22 for storing and comparison of electric pulses.

The operative memory unit 22 for storing and comparing the electric pulses is based on an operational amplifier 23 having a feedback circuit with a capacitor 24 inserted therein. Connected to the operative memory unit 22 is a unit 25 (FIGS. 2, 8) to compare the obtained difference in the parameters of the electric pulses with a specified value for the given color relation of the beds. This unit 25 (FIG. 8) is based on an operational amplifier 26 having two inputs, one of which is supplied with a specified voltage determined by the relation of the color of the selected beds. The obtained difference in the parameters of the separated pulses is applied to the other input of the amplifier 26. The output of the unit 25 is connected to the actuating members 27 for moving the objective 5. In the given case this unit consists of a reversible motor 28 and a reduction gear 29 which moves the objective 5.

The actuating member 27 for moving the objective 5 is coupled with a unit 30 for measuring the deviation of the mining machine from the bed profile, transforming the angular displacement of the objective 5 into a corresponding electric signal.

The unit 30 for measuring the displacement of the objective 5 may be made in the form of any transducer converting the linear or angular displacement of the objective 5, into an electric signal. The output of this unit 30 is connected to a comparator unit 31 to compare the deviation of the cutting loading machine with the specified allowance 2Δ (FIGS. 2, 7) for the accuracy of guiding the machine. The output of the unit 31 is connected to a unit 32 for producing control signals to control the motion of the machine 1. Depending on the magnitude and direction of deviation of the machine 1 (FIG. 1) from the bed profile, the unit 32 produces corresponding control signals to be transmitted to the actuating members 3 (FIG. 1) of the machine 1, in this case-hydraulic jacks, for moving the cutting member 4 in a vertical plane.

The device is adjusted when the machine 1 (FIG. 1) is exactly in the profile of the bed of the mineral deposit. In this case the light source 11 illuminates the section A of the face having at least two beds featuring different colors.

The reflected light flux is received by the objective 5 and in this case the scanner unit 14 divides the image of the monitored bed into two equal parts. The scanner unit 14 alternately shuts off the separated light fluxes so that a periodic train of pulses having voltage amplitudes $U_1$ and $U_2$ (FIG. 5) is shaped at the output of the photodiode 13 (FIG. 8).

The synchronizer 21 (FIGS. 2. 8) controls the operation of the scanning unit 14 supplying in turn, in time intervals $T_1$ and $T_2$ (FIG. 5), current pulses to the windings of the electric magnets 16 (FIG. 2). Under the effect of the magnetic field the diaphragm 15 moves alternately up and down thus dividing the image of the face section into two equal parts and overlapping them in turn. The electric pulses shaped at the output of the photodiode 13 (FIG. 8) and amplified by the amplitier 17 are fed to the pulse separating unit 18.

Figure 9:
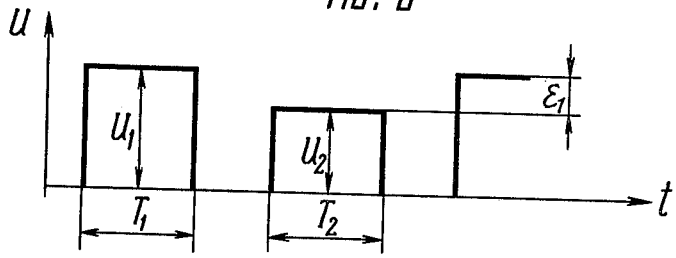
FIG. 9 is a voltage diagram showing the voltages at the input of the unit for separating the shaped electric pulses.
Figure 10:
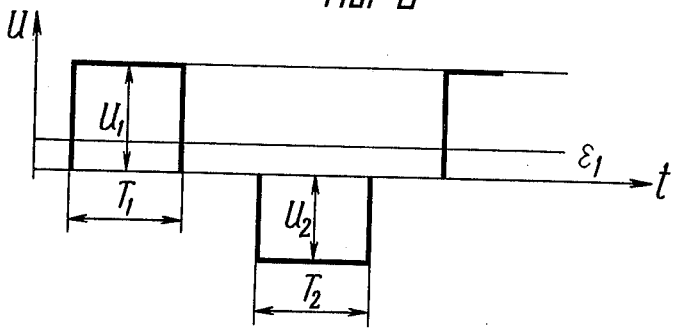
FIG. 10 is a voltage diagram showing the voltages at the output of the unit for separating the shaped electric pulses.

The synchronizer 21 connected to the scanner unit 14 (FIG. 2) and switch 20 (FIG. 8) provides their simultaneous operation so that during the time period $T_1$ (FIG. 5) the scanner unit 14 (FIG. 2) overlaps the lower half of the image of the objective 5, and the reflected light flux, having passed through the upper half of the objective 5, is converted into electric pulses by the photoelectric receiver 6. These pulses are amplified by the amplifier 17 and are fed with an amplitude $U_1$ (FIG. 5) to the input of the unit 18 (FIG. 2) for separation of electric pulses. In this case during the time period $T_1$ (FIG. 9) the switch 20 (FIG. 8) is closed and at the output of the unit 18 there appears a voltage pulse with an amplitude $U_1$ (FIG. 9). During the time period $T_2$ the scanner unit 14 (FIG. 2) overlaps the upper half of the image of the objective 5, and at the output of the unit 18 (FIG. 2) there appears a voltage pulse with an amplitude $U_2$ (FIG. 9). In this case during the time period $T_2$ the switch 20 (FIG. 8) is open, the voltage pulse $U_2$ (FIG. 9) is inverted by the inverter 19, (FIG. 8) and at the output of the unit 18 there appears a voltage pulse with an amplitude $U_2$ (FIG. 10) but having opposite polarity.

Then the operating cycle of the device is repeated. This periodic train of heteropolar voltage pulses $U_1$, $U_2$ (FIG. 10) is applied to the operative storage and comparison unit 22 (FIG. 2), e.g. an integrator. The unit 22 is used for storing and comparing the amplitudes of the supplied pulses, and the output of this unit produces a voltage difference $E_1 = U_1 - U_2$. This difference is constant for the given relation of the bed colors. The voltage $E_1 = U_1 - U_2$ is fed to the comparator unit 25 for comparison of the obtained difference of the parameters of the electric pulses with a specified constant value.

The constant difference of the parameters of the electric pulses taken equal to $E_1$ is determined at the accurate adjustment of the objective 5 (FIG. 2) with respect to the boundary of the two beds. Any other relation of the colors of the beds results in corresponding change in $E_1$. In this case the winding of the electric motor 28 is deenergized. The output signal of the unit 30 for measuring the deviation of the machine from the bed profile is equal to zero and the unit 32 does not produces a control signal to the hydraulic jacks driving the cutting member 4 (FIG. 1) so that the latter remains in the bed profile.

Figure 6:
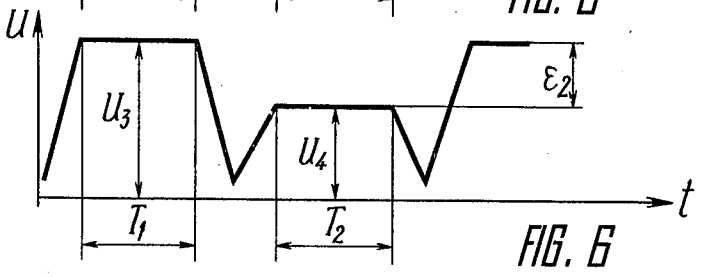
FIG. 6 is a diagram of shaping electric pulses corresponding to the color ratio of the selected beds when the machine deviates from the bed profile.

When the machine 1 deviates from the bed profile, the image of the monitored bed moves away from its initial position and at the output of the photoelectric receiver 6 (FIG. 2) there is shaped a periodic train of voltage pulses with amplitudes $U_3$ and $U_4$ (FIG. 6). The operative storage and comparison unit 22 (FIG. 2) produces an output voltage $E_2 = U_3 - U_4$, which differs from the voltage $E_1$, and the comparator unit 25 produces an error voltage whose amplitude characterizes the displacement of the objective from the boundary of the two beds, the polarity of the error voltage characterizing the direction of this displacement. This voltage is fed to the winding of the electric motor 28, which through the reduction gear 29 moves the objective 5 up or down until $E_2$ becomes equal to $E_1$, i.e. until the image of the boundary of the beds is in the centre of the objective 5. Thus, the objective 5 (FIG. 2) traces the monitored boundary of the beds independently of the position of the cutting loading machine 1 (FIG. 1). During the motion of the objective 5 a non-zero signal appears at the output of the unit 30. In order to optimize the operating conditions of the mining 4 (FIG. 1) of the cutting loading machine 1 at insignificant changes and sharp fluctuation of the bed profile, which have no effect on the quality of the produced ore but drastically deteriorate the operating conditions of the machine itself, the signal of the unit 30 is levelled and compared with a specified allowance 2Δ for accuracy of guiding the machine effected by the unit 31. If the levelled signal overpasses the specified allowance, a signal appears at the output of the unit 31, which is fed to a unit sending control signals to the hydraulic jacks 3, which move the cutting member 4 until the output signal of the unit 31 becomes equal to zero. Thus, smooth and accurate automatic control of the motion of the cutting loading machine along the profile of the mineral bed is performed.

We claim:

1. A photoelectric method of automatically controlling the motion of a mining machine along a seam profile of a mineral deposit comprises the steps of illuminating a section of a face having at least two beds of different colors to form a boundary layer or seam; detecting the light flux reflected simultaneously from at least two beds having different colors; generating first and second electric signals corresponding to the light fluxes detected from two different color beds; comparing said first and second signals and forming a working signal; establishing a reference signal selected to have a predetermined value for the colors of the beds being illuminated; determining the value and direction of deviation of the mining machine with reference to the boundary or seam by comparing said working and reference signals; generating correcting control signals which are a function of the value and direction of deviation of the mining machine; and applying said control signals to the mining machine to minimize or eliminate such mining machine deviation.

2. A method as defined in claim 1, wherein the light fluxes reflected from the two beds are successively or alternately detected in a predetermined time interval.

3. A method as defined in claim 2, wherein said first and second signals together form a periodical succession of electric pulses having amplitudes which are a function of the respective colors of the beds.

4. A method as defined in claim 3, wherein different pulse amplitudes of successive electric pulses are obtained by directing the detected light fluxes onto a photocell having a substantially linearly variable characteristic portion.

5. A method as defined in claim 3, wherein said pulses are separated and grouped to correspond to associated color beds, and wherein the pulse amplitudes of different groups are compared to obtain said working signal.

6. A method as defined in claim 5, wherein tracking of the boundary is achieved by maintaining the pulse amplitude difference constant for beds of given colors.

7. A method as defined in claim 6, wherein said amplitude difference corresponds to said working signal, which is made equal to said reference signal.

8. A method as defined in claim 1, wherein detection of said light flux and generation of said first and second signals is autonomous and independent of the direction of the motion of the machine.

9. A method as defined in claim 1, further comprising the steps of establishing a value of accuracy allowance for guiding the machine; levelling the value of deviation of the machine from the bed profile with said value of accuracy allowance; comparing said allowance and deviation values; and producing an actuating signal for guiding the machine when the levelled value deviation exceeds the specified value of allowance.

10. A device for effecting automatic control of motion of a mining machine along the profile of a mineral bed comprising in combination: a light source for illuminating a face; an objective for detecting the light flux reflected from a section of said face; a photoelectric receiver for converting the reflected light flux into electric signals located behind said objective; a scanner unit for scanning the reflected light beams located between said objective and said photoelectric receiver; a unit for separating the shaped electric pulses electrically connected to said photoelectric receiver; a synchronizer electrically connected to said scanner unit and said unit for separating electric pulses providing simultaneous operation of said scanner unit and said unit for separating electric signals; a unit for operative storage and comparison of the electric pulses obtained due to conversion of said reflected light fluxes electrically connected to the output of said unit for separating the shaped electric pulses; a comparator unit for comparison of the obtained difference in the parameters of said electric pulses with a value specified for the given beds electrically connected to the output of the unit for operative storage and comparison of electric pulses; an actuating member to move said objective connected to said comparator unit; a unit for measuring the value of deviation of the mining machine from the bed profile connected to said actuating unit to move said objective; a unit to compare the value of deviation of the machine with the specified allowance for accuracy of guiding the machine electrically connected to said unit for measuring the value of deviation of the machine from the bed profile; and a unit for producing control signals to control the mining machine connected to said unit comparing the value of deviation with the specified allowance for accuracy of guiding the machine.

11. A device as defined in claim 10, wherein said pulse separation unit comprises an inverting amplifier; and a switch connected in parallel to said inverting amplifier and actuated by said synchronizer.

12. A device as defined in claim 10, wherein said storage and comparison unit comprises an operational amplifier having an input and an output; and a capacitor connected between said input and output to form an integrator.

* * * * *